US006624369B2

(12) United States Patent
Ito et al.

(10) Patent No.: US 6,624,369 B2
(45) Date of Patent: Sep. 23, 2003

(54) KEYBOARD DEVICE AND METHOD FOR MANUFACTURING THE SAME

(75) Inventors: Takayuki Ito, Fukushima-ken (JP); Tsuyoshi Narusawa, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 106 days.

(21) Appl. No.: 09/919,744

(22) Filed: Aug. 1, 2001

(65) Prior Publication Data

US 2002/0014398 A1 Feb. 7, 2002

(30) Foreign Application Priority Data

Aug. 7, 2000 (JP) ..... 2000-244046
Aug. 7, 2000 (JP) ..... 2000-244048

(51) Int. Cl.[7] ..... H01H 13/14
(52) U.S. Cl. ..... 200/344
(58) Field of Search ..... 200/344

(56) References Cited

U.S. PATENT DOCUMENTS 5,399,822 A * 3/1995 Sato et al. ..... 200/344
5,967,298 A 10/1999 Watanabe et al. ..... 200/344
6,127,640 A * 10/2000 Pan et al. ..... 200/344

* cited by examiner

*Primary Examiner*—Renee Luebke
(74) *Attorney, Agent, or Firm*—Brinks Hofer Gilson & Lione

(57) ABSTRACT

A keyboard device includes a lever-mounting plate which mates with a pair of levers at lower ends thereof and a holding plate for mounting the lever-mounting plate. The lever-mounting plate is provided with a mating unit to mate with the holding plate by snapping. The lever-mounting plate provided with the mating unit can be mounted to the holding plate through one-touch operation, whereby mounting becomes simple and manufacturing processes are easily automated.

14 Claims, 15 Drawing Sheets

KEYBOARD DEVICE AND METHOD FOR MANUFACTURING THE SAME

BACKGROUND OF THE INVENTION

1. Field of the Invention

The present invention relates to keyboard devices, in particular, to a keyboard device including a plurality of key tops capable of moving vertically and to a method for manufacturing the keyboard device.

2. Description of the Related Art

Recently, in response to requirements for low-profile keyboard devices, various keyboard devices have been proposed, in which each key top is supported by upper ends of a pair of levers which are linked with each other in a cross, and angles between each linked lever vary in accordance with vertical movement of the key top.

For example, a key switch has been disclosed, in which a pair of the levers are linked at an intersection thereof so that an upper end of the one of levers is rotatably coupled with a key top at a bottom side thereof, and an upper end of the other lever is slidingly mate with the key top at the bottom face thereof. The pair of levers linked with each other support the key top vertically movable.

In such a keyboard device which uses the above-described key switches, when an operator depresses a key top, the pair of levers are pressed downward by being tilted until the key top descends by a predetermined amount, then an elastic member such as a so-called click rubber is deformed by being pressed, and a switch element such as a sheet-shaped membrane switch is closed by the elastic member and thereby switches on.

When a pressing force applied to the key top is released in the switched-on state, the deformed elastic member is restored to the original form by its elastic force, the membrane switch moves into an off-state, and the elastic member raises the tilted levers, thereby pushing the key top to the original position.

By using a pair of the levers which support the key top vertically movable, a superior maneuverability is secured, and the overall thickness can be significantly reduced, whereby the keyboard device can be made low-profile, compared with a conventional keyboard device.

In the known keyboard device, a sheet-shaped membrane switch is mounted on a metallic plate which is provided with a plurality of mating parts formed by cutting and raising the metallic plate. A pair of the levers mate with the mating parts at lower ends of the levers, and a key top is mounted vertically movable to the pair of levers at the upper ends thereof.

In the known keyboard device, there has been a problem in that components of the device cannot be easily assembled, due to wrinkles of the membrane switch being produced and the like, when a pair of the levers are mounted to the mating parts of the metallic plate at the lower ends of the levers, because the membrane switch mounted on the metallic plate is thin.

The metallic plate is provided with a plurality of the mating parts, formed by cutting and raising the metallic plate, for mating with the pair of levers at the lower ends thereof. Various types of such a metallic plate must be prepared because mounting positions and mounting pitch of key switches differ from each other according to the requirements of users.

Therefore, the number of molds for manufacturing metallic plates increases, whereby manufacturing costs of the keyboard devices are increased.

The key tops used for known keyboard devices have been formed thin for reducing the thickness of the overall keyboard devices. Each of the thin key tops has been provided with a rotatable-mating part and a sliding-mating part formed integrally with the key top on a bottom face of the thin key top, for rotatable and sliding-mating with the upper ends, respectively, of a pair of the levers.

These key tops have been each mated with the pair of levers at upper ends thereof in such a manner that each key top is positioned on the pair of levers, and the rotatable-mating part and the sliding-mating part of the key top are mated with the upper ends of the pair of levers. However, since the rotatable-mating part and the sliding-mating part are formed on a bottom face of the key top, it has been difficult to position the rotatable-mating part and the sliding-mating part with respect to the respective upper ends of the pair of levers, whereby a problem has been found in that it is difficult to automate manufacturing.

SUMMARY OF THE INVENTION

Accordingly, it is an object of the present invention to provide a keyboard device which is manufactured in a simple manner and is easily manufactured in automated processes and a method for manufacturing the keyboard device, in which a lever-mounting plate mates with a pair of levers at lower ends thereof, and the lever-mounting plate mounted with the pair of levers is mounted to a holding plate by snapping and is mounted on a membrane switch.

It is another object of the present invention to provide a keyboard device of which manufacturing processes are easily automated, in which an actuator is provided which mates with a pair of levers at upper ends thereof in such a manner that the upper ends of the pair of levers are respectively mated with a rotatable-mating unit by snapping and a sliding-mating unit by sliding by moving the actuator horizontally from one position to another position, whereby the pair of levers can be easily mounted to a key top and manufacturing processes can be thereby easily automated.

To these ends, according to an aspect of the present invention, a keyboard device comprises a pair of levers rotatably connected to each other at an intersection therebetween; a key top which is vertically movable and is supported by the pair of levers; an elastic member for elastically urging the key top upward; a switching element for performing switching in accordance with vertical movement of the key top; a lever-mounting plate for mating with the pair of levers at lower ends of the levers, the lever-mounting plate being provided with a mating unit; and a holding plate for holding the lever-mounting plate by snapping at the mating unit of the lever-mounting plate.

The lever-mounting plate may be made of a metallic plate which has a planar base part, the mating unit may include sidewalls opposing each other formed by cutting and raising widthwise ends of the base part, and the holding plate may be provided with a plurality of mounting holes, the mating unit mating with one of the mounting holes by snapping.

The mating unit may be provided with protrusions each protruding toward the outside in the widthwise direction from a part of each sidewall, and the mating unit may mate with the one of the mounting holes by snapping at the protrusions.

The sidewalls of the mating unit continuing from the base part may be each provided with a hook formed by separating a part of the sidewall from the base part, the hook may be formed with an end of the part of the sidewall, the hook being inclined and protruding toward the outside in the widthwise direction, and the hooks may mate with the one of the mounting holes by snapping.

The mounting holes may be rectangular and each mounting hole may be defined by first edges opposing each other and second edges opposing each other, the mating unit may be formed at the widthwise ends toward one side of the base part, a positioning unit may be formed by cutting and raising a portion of the base part toward the other side of the base part, and the mating unit may mate with the one of the mounting holes by snapping at the second edges opposing each other of the one of the mounting holes such that one end face of the mating unit comes into contact with one of the first edges and the positioning unit comes into contact with the other one of the first edges.

The base part may include a first anti-removal part which extends toward the outside from a portion of the base part toward the one side of the base part between the widthwise ends at which the mating unit is disposed and a second anti-removal part which extends toward the outside from the positioning unit which is disposed toward the other side of the base part, the first and second anti-removal parts coming into contact with a bottom surface of the holding plate when the mating unit mates with the one of the mounting holes by snapping.

According to another aspect of the present invention, a method for manufacturing a keyboard device comprises the steps of rotatably connecting a pair of levers to each other at an intersection therebetween; mating the pair of levers with an actuator so that upper ends of the pair of levers vertically move in accordance with vertical movement of a key top; and mating, by snapping, a lever-mounting plate with one of a plurality of mounting holes formed in a holding plate in an upward direction, the lever-mounting plate being mated with the pair of levers at lower ends thereof, whereby the lever-mounting plate is mounted to the holding plate.

In the method for manufacturing a keyboard device, a mating unit may be formed on the lever-mounting plate, the mating unit being capable of mating with the one of the mounting holes by snapping, and the mating unit may be mated with the one of the mounting holes by snapping by lifting the lever-mounting plate disposed under the holding plate.

According to still another aspect of the present invention, a keyboard device comprises a pair of levers rotatably connected to each other at an intersection therebetween; a key top which is vertically movable and is supported by the pair of levers; an elastic member which urges the key top upward; a switching element for performing switching in accordance with vertical movement of the key top; and an actuator coupled with the key top, for mating with the pair of levers at upper ends thereof, the actuator being provided with a rotatable-mating unit including an aperture at which one of the upper ends of the pair of levers rotatably mates with the rotatable-mating unit and a sliding-mating unit including an aperture at which the other one of the upper ends of the pair of levers is slidingly mates with the sliding-mating unit. The apertures of the respective rotatable-mating unit and the sliding-mating unit are open in the same direction as each other.

The rotatable-mating unit may be formed in a U-shape and be disposed at an end of the actuator, and may be provided with a projection formed in the vicinity of the aperture on at least one of two side members opposing each other which form the U-shaped rotatable-mating unit, the projection serving to narrow the aperture.

The sliding-mating unit may be formed in a U-shape and be disposed at an end of the actuator, and two side members may be formed opposing each other and parallel to each other, the two side members forming the U-shaped sliding-mating unit.

The actuator may be made of a metallic plate and be provided with the sliding-mating unit formed by cutting and bending the end of the actuator and the rotatable-mating unit formed by cutting and bending the other end of the actuator.

According to yet another aspect of the present invention, a method for manufacturing a keyboard device comprises the steps of rotatably connecting a pair of levers to each other at an intersection therebetween; mating an actuator with a key top, the actuator being capable of mating with the pair of levers at upper ends thereof, such that the pair of levers vertically move via the actuator in accordance with vertical movement of the key top which is elastically urged by an elastic member; and mating the actuator with the pair of levers in such a manner that the actuator is positioned on the pair of levers at the upper ends thereof and is moved from one position to another position, whereby the actuator mates with the pair of levers at the upper ends thereof.

In the method for manufacturing a keyboard device, by moving from the one position to the other position, the actuator mates by snapping a rotatable-mating unit provided at one end of the actuator with the pair of levers at one of the upper ends thereof and slidingly mates a sliding-mating unit provided at the other end of the actuator with the pair of levers at the other one of the upper ends thereof.

Since the lever-mounting plate is provided with a mating unit for mating with the holding plate by snapping, the lever-mounting plate can be temporarily fixed to the holding plate only by snapping through one-touch operation. Therefore, mounting operation can be easily performed, and manufacturing processes can be easily automated.

The lever-mounting plate having a planar base part is made of a metallic plate. The mating unit is formed with sidewalls which are formed opposing each other by cutting and raising widthwise ends of the base part, and the holding plate is provided with a plurality mounting holes each to mate with the mating unit of the lever-mounting plate by snapping. Therefore, the lever-mounting plate can be temporarily mated with each mounting hole only by snapping the mating unit to the mounting hole, whereby mounting operation is more easily performed.

The mating unit is provided with projections projecting to the outside in the widthwise direction, each formed on the sidewall. Since the mating unit mates with the mounting hole by snapping to the projections, the mating unit is prevented from removal by being reliably mated by snapping to the projections.

The mating unit is provided with hooks each formed by cutting and raising a part of the sidewall connected the base part, the part of the sidewall forming the hook which is inclined and protruding to the outside in the widthwise direction of the base part. The mating unit mates with the mounting hole by snapping at the hooks, thereby reliably preventing the lever-mounting plate from removal.

When a positioning unit is provided at a side of the base part opposite to the side at which the mating unit is provided and the mating unit mates, by snapping, with the mounting hole so as to be in pressure-contact with the second edges of the mating hole opposing each other, one end face of the mating unit comes into contact with one of the first edges of the mating hole and the positioning unit comes into contact with the other one of the first edges, whereby the movement of the lever-mounting plate temporarily mated with the mounting hole by snapping is restricted. The lever-mounting plate is not removed from the mounting hole even when a twisting force is applied to the lever-mounting plate.

When the mating unit of the lever-mounting plate mates with the mounting hole by snapping, the first and second anti-removal parts come into contact with the bottom surface of the holding plate. The pressing force for mating the mating unit of the lever-mounting plate with the mounting hole by snapping is received by the first and second anti-removal parts, whereby the lever-mounting plate can be reliably fixed temporarily to the holding plate.

In a manufacturing method according to the present invention, since the lever-mounting plate is mated in an upward direction with the mounting hole formed in the holding plate by snapping, the lever-mounting plate can be mounted to the holding plate through one-touch operation by snapping. Therefore, a keyboard device, of which mounting can be easily performed and be automated easily, is obtainable.

The lever-mounting plate includes a mounting unit for mating with the mounting hole by snapping. By lifting the lever-mounting plate placed under the holding plate, the mounting unit of the lever-mounting plate is mated with the mounting hole through one-touch operation by snapping. With this arrangement, mounting can be easily performed and be automated easily.

DESCRIPTION OF THE PREFERRED EMBODIMENTS

Figure 1:
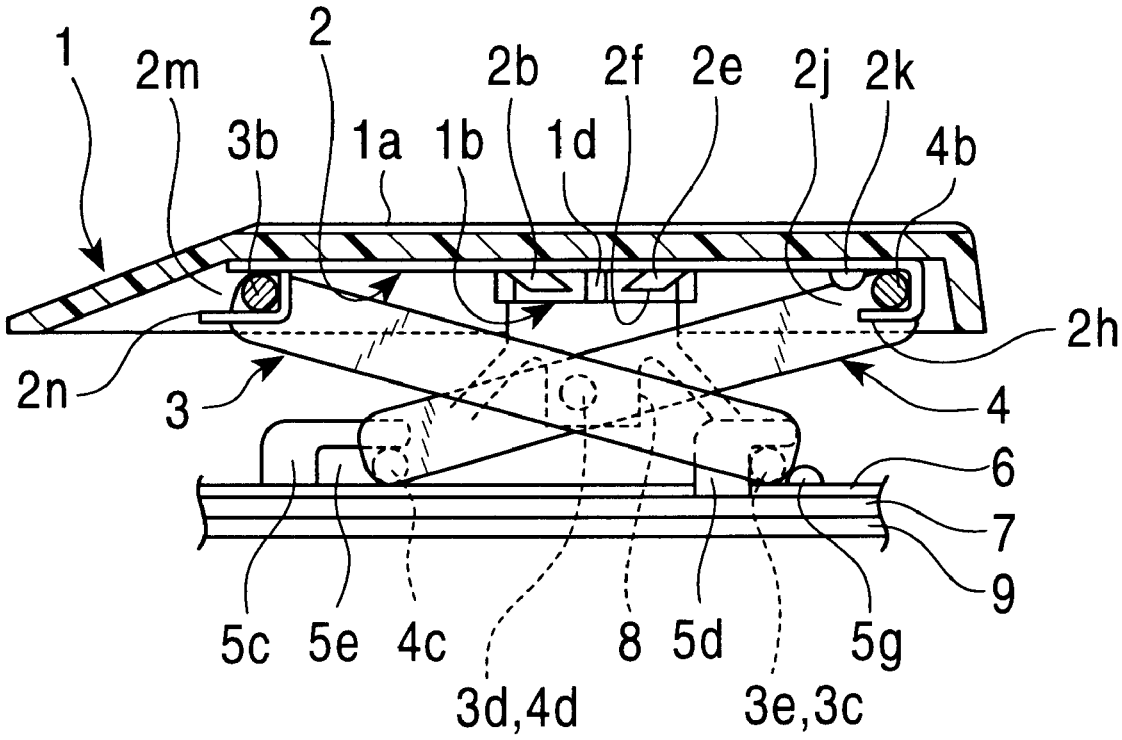
FIG. 1 is a sectional view of a critical portion of a keyboard device according to the present invention.
Figure 3:
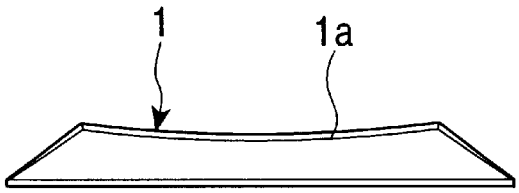
FIG. 3 is a front view of a key top, according to the present invention.

A keyboard device according to the present invention is provided with key tops 1 at an uppermost part, one of which is shown in FIG. 1. The key top 1 is described below with reference to FIGS. 3 to 5.

The key top 1 is formed of a resin by molding or the like substantially in a rectangle. The key top 1 is provided with an arc-shaped manipulation face 1*a* on the upper face, and a protrusion 1*b* formed as a square pole substantially at a central part of the bottom face of the key top 1. Four side faces 1*c* of the square-pole-shaped protrusion 1*b* are each planarly formed.

Figure 4:
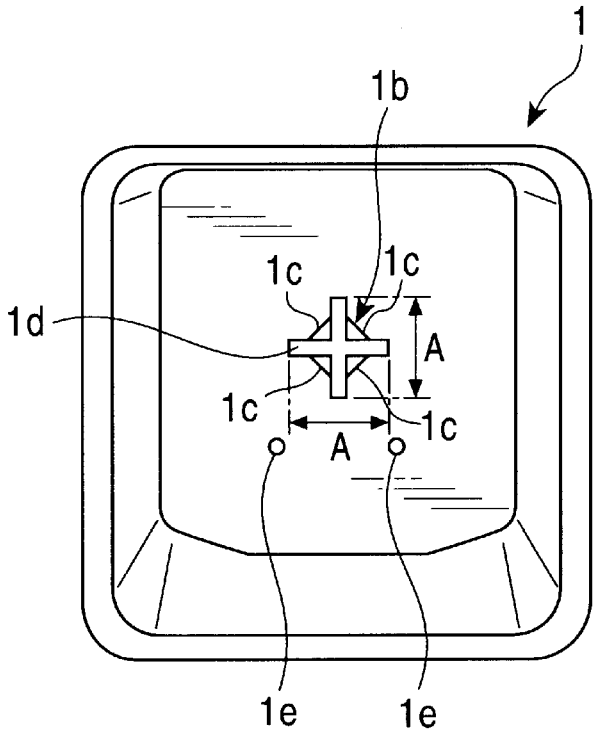
FIG. 4 is a bottom view of the key top shown in FIG. 3.
Figure 5:
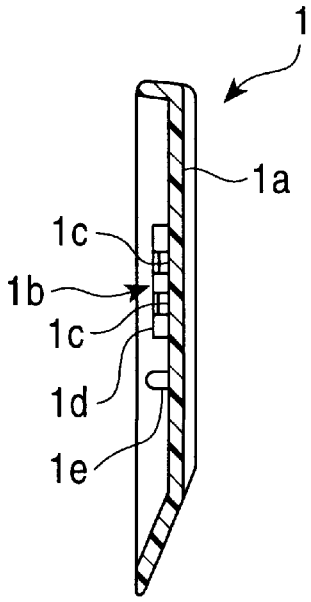
FIG. 5 is a sectional view of a critical portion of the key top shown in FIG. 4.

In FIG. 4, the protrusion 1*b* is provided with a pressing part 1*d* formed in a cross, each end of members forming the cross of the pressing part 1*d* projecting from a corner of the adjacent side faces 1*c* toward the outside in a diagonal direction. A length A of the pressing part 1*d* in the diagonal direction of the protrusion 1*b* is set greater than a diameter C of a top 8*c* of an elastic member 8 which is described below. The key top 1 can move vertically while the elastic member 8 is directly urging the pressing part 1*d*.

A pair of positioning protrusions 1*e* are formed protruding in the vicinity of the lower part of the protrusion 1*b* shown in FIG. 4.

An actuator 2 which is made of a metallic plate such as a stainless steel plate mates with the key top 1 at the protrusion 1*b*. When the actuator 2 mates with the key top 1, a planar mounting-face 2*a* of the actuator 2 comes into close contact with the key top 1 at the bottom face thereof.

An anti-removal part 2*b* is formed substantially at a central part of the mounting face 2*a* of the actuator 2 to which the protrusion 1*b* of the key top 1 can be press-fitted. The anti-removal part 2*b* is provided with a through-hole 2*c* defined by inner walls 2*d*, four cantilever pressure-contact tabs 2*e* each protruding toward the inside from the inner wall 2*d*.

Figure 8:
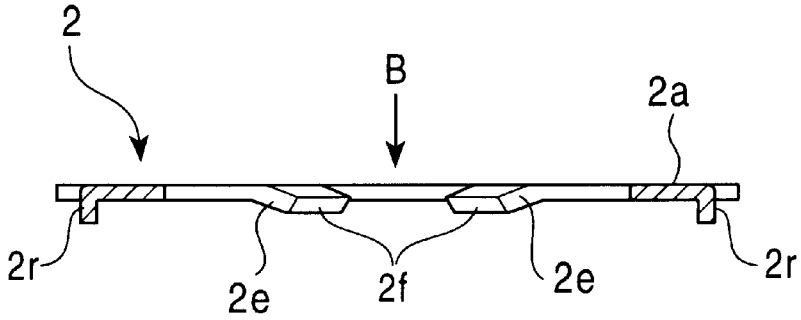
FIG. 8 is an expanded sectional view of a critical portion of the actuator shown in FIG. 6.

The cantilever pressure-contact tabs 2*e* are slightly bent downward at respective ends 2*f* thereof, as shown in an expanded view in FIG. 8. When the protrusion of the key top 1 is press-fitted to the anti-removal part 2*b* in a direction B, the ends 2*f* of the four pressure-contact tabs 2*e* are brought into pressure-contact to the four side faces 1c of the protrusion 1*b*, respectively, whereby the key top 1 mates with the actuator 2, so as to be prevented from removal.

Since the actuator 2 is made of a metallic plate and the key top 1 is made of a resin, the ends 2*f* of the pressure-contact tabs 2*e* mate with the respective side faces 1*c* of the protrusion 1*b* of the key top 1 so as to cut into the side faces 1*c*, whereby the removing force of the key-top 1 from the actuator 2 can be increased, and the key top 1 can be firmly coupled with the actuator 2.

Figure 6:
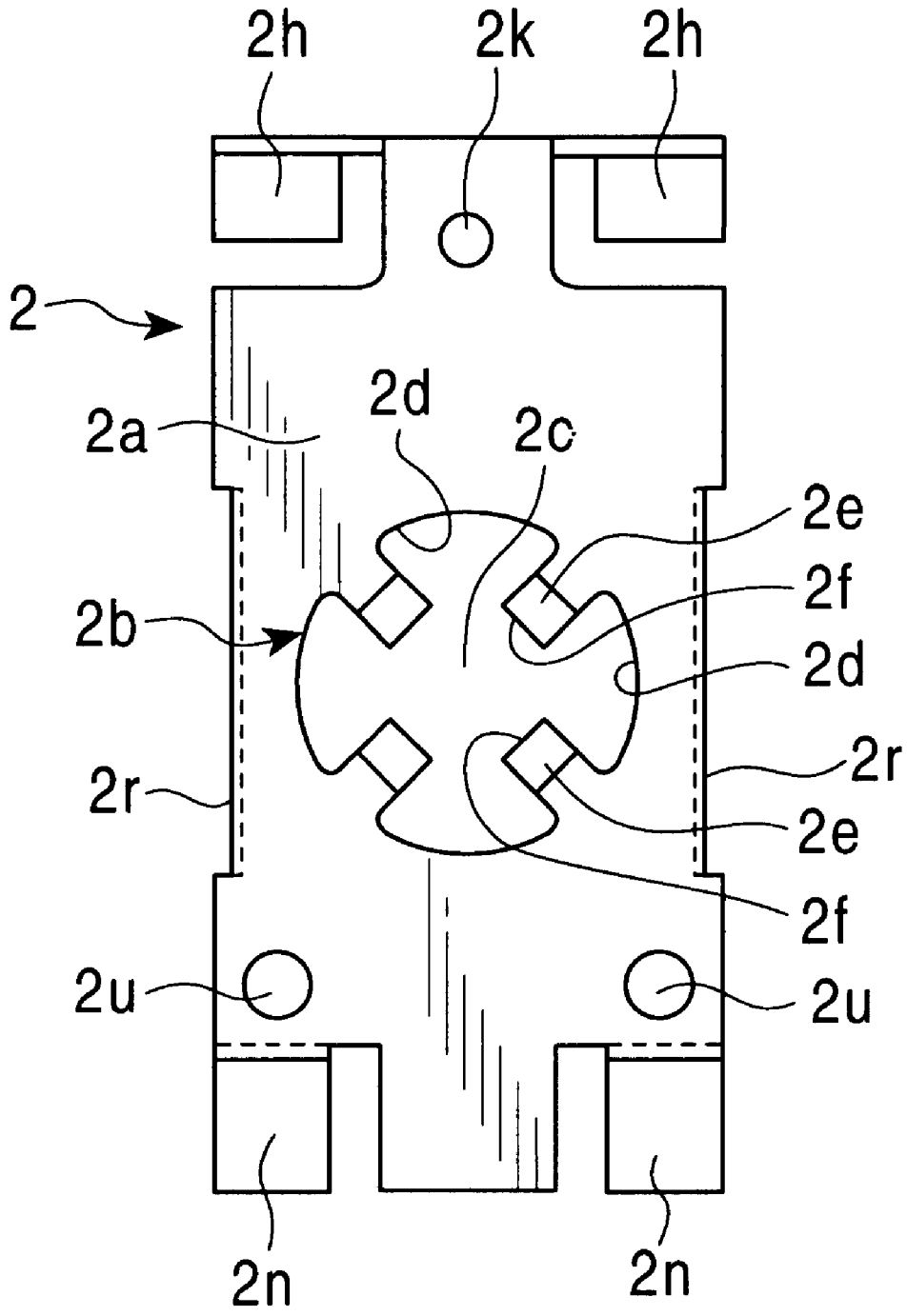
FIG. 6 is a plan view of an actuator, according to the present invention.
Figure 7:
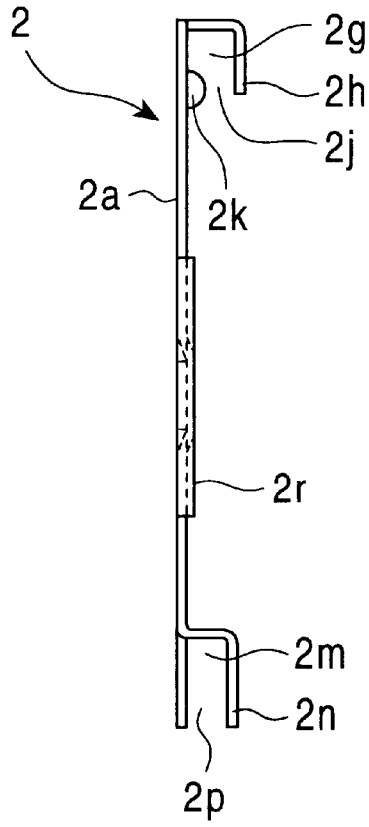
FIG. 7 is a side view of the actuator shown in FIG. 6.

The actuator 2 shown in FIG. 7 includes a rotatable-mating unit 2*g* formed substantially in a U-shape in side view at a longitudinal end of the mounting face 2*a*. As shown in FIG. 6, a widthwise intermediate part of the mounting face 2*a* extends upward in the drawing, the extended part of the mounting face 2*a* further extends to the left and to the right in the drawing, and the further extended parts form two individual mating tabs 2*h*. The mating tabs 2*h* are bent so as to form the rotatable-mating part 2*g*, as shown in FIG. 7.

The rotatable-mating part 2*g* shown in FIG. 7 is formed in a U-shape in side view with the mounting face 2*a* and the mating tabs 2*h* extending in parallel to each other. The rotatable-mating part 2*g* is provided with an aperture 2*j* open downward. The mounting face 2*a* is provided with a projection 2*k* in the vicinity of the aperture 2*j* so as to narrow the aperture 2*j*.

An upper rotational axle 4*b* of an outer lever 4 which is described below is snapped into the rotatable-mating part 2*g* through the narrowed aperture 2*j* so that the upper rotational axle 4*b* is rotatable in the rotatable-mating part 2*g*.

The projection 2*k* which narrows the aperture 2*j* may be formed at the side of the mating tabs 2*h* or at the sides of the mounting face 2*a* and the mating tabs 2*h*.

That is, the projection 2*k* for narrowing the aperture 2*j* may be formed, in the vicinity of the aperture 2*j*, on one of the members (the mounting face 2*a* or the mating tabs 2*h*) opposing each other or on the two members.

The actuator 2 shown in FIG. 7 includes a sliding-mating part 2*m* formed substantially in a U-shape in side view at the other longitudinal end of the mounting face 2*a*, the sliding-mating part 2*m* being provided with an aperture 2*p* formed in a substantially U-shaped section.

As shown in FIG. 6, the sliding-mating part 2*m* is formed with a widthwise intermediate part of the mounting face 2*a* extending downward in the drawing, and tongue-shaped mating tabs 2*n* disposed toward the right and left, respectively, of the extended part of the mounting face 2*a*, the mating tabs 2*n* being bent in an L-shape in side view.

In the sliding-mating part 2*m*, two members (the mounting face 2*a* and the mating tabs 2*n*) disposed in parallel to each other form the aperture 2*p*. The sliding-mating part 2*m* slidingly mates with an upper sliding axle 3*b* of an inner lever 3 which will be described below.

The aperture 2*j* of the rotatable-mating part 2*g* and the aperture 2*p* of the sliding-mating part 2*m* open in the same downward direction as each other, as shown in FIG. 7.

In FIG. 6, positioning holes 2*u* are provided in the mounting face 2*a* in the vicinity of the mating tabs 2*n* forming the sliding-mating part 2*m*. The positioning protrusions 1*e* of the key top 1 couple with the positioning holes 2*u*.

The longitudinal sides of the mounting face 2*a* are bent to form a pair of reinforcing parts 2*r* in portions of the mounting face 2*a* in the vicinity of the anti-removal part 2*b*, as shown in FIG. 6.

The reinforcing parts 2*r* prevent the planar mounting-face 2*a* from bending when the actuator 2 vertically moves with the inner and outer levers 3 and 4 mating with the sliding-mating part 2*m* and the rotatable-mating part 2*g*, respectively, of the actuator 2.

Figure 13:
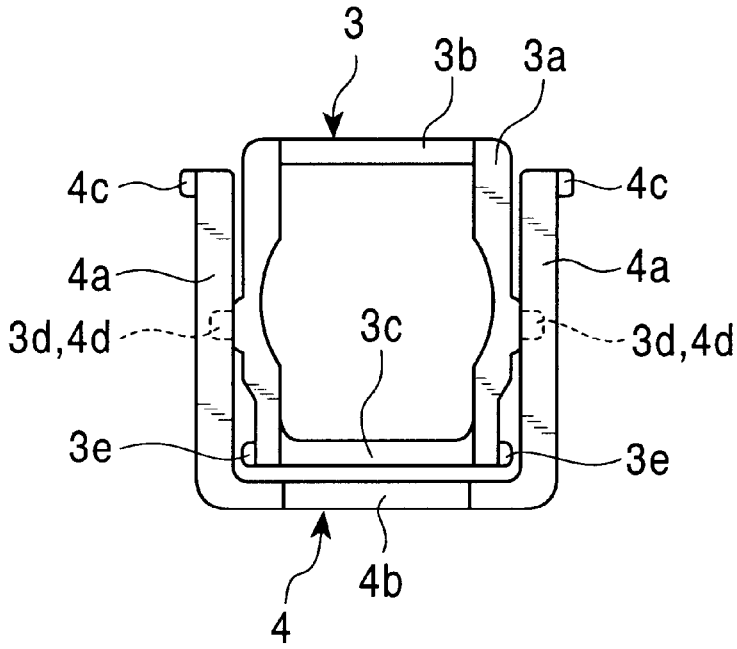
FIG. 13 is a plan view of the inner lever and the outer lever shown in FIGS. 9 and 11, respectively, according to the present invention, the inner and outer levers being assembled with each other.

The inner and outer levers 3 and 4 which mate with the sliding-mating unit 2*m* and the rotatable-mating unit 2*g*, respectively, of the actuator 2 are made of resins having coefficients of contraction differing from each other. The inner and outer levers 3 and 4 are assembled with each other, as shown in FIG. 13.

The inner lever 3 and the outer lever 4 of materials differing from each other are assembled in a mold by inlay molding.

Figure 9:
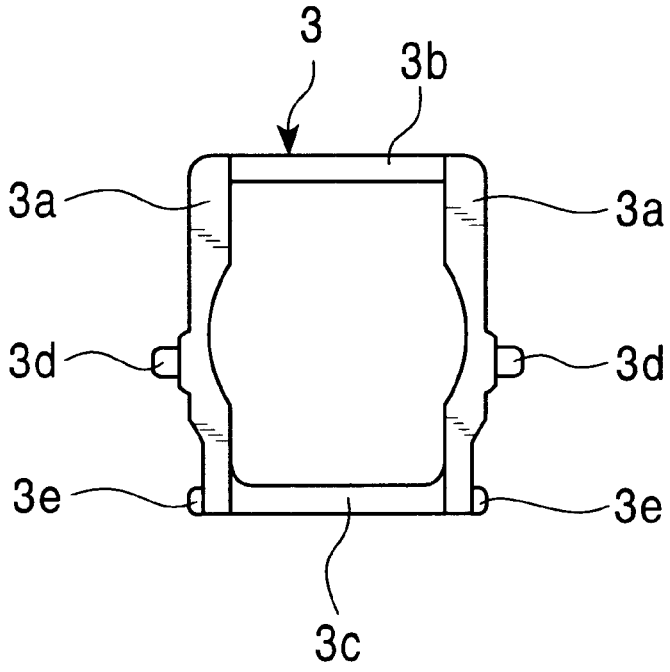
FIG. 9 is a plan view of an inner lever, according to the present invention.
Figure 10:
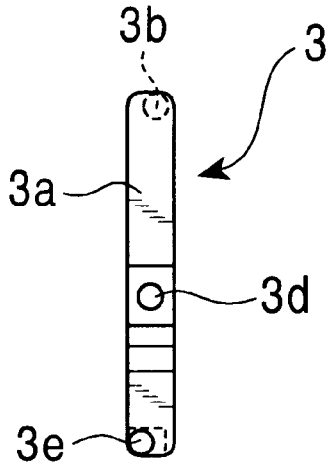
FIG. 10 is a side view of the inner lever shown in FIG. 9.

In FIGS. 9 and 10, the inner lever 3 includes a pair of vertically-extending tilting legs 3*a*. The tilting legs 3*a* are connected to each other via the upper sliding axle 3*b* disposed in an upper part of the inner lever 3 and a lower rotational axle 3*c* disposed in a lower part of the inner lever 3, and the inner lever 3 is thereby formed substantially in a rectangle.

The pair of tilting legs 3*a* are individually provided with connecting pins 3*d* each projecting toward the outside at a vertically intermediate part of the tilting leg 3*a*, as shown in FIGS. 9 and 10. The inner lever 3 is provided with lower rotational pins 3*e* each projecting along an extending line of the lower rotational axle 3*c* to the right or left in the drawing.

In the inner lever 3, as shown FIG. 1, the upper sliding axle 3*b* which is disposed in the upper part of the inner lever 3 slidingly mates with the sliding-mating part 2*m* of the actuator 2, and the lower rotational axle 3*c*, which is disposed in the lower part of the inner lever 3, rotatably mates with a lever-mounting plate 5, which is described below, at the lower rotational pins 3*e*.

Figure 11:
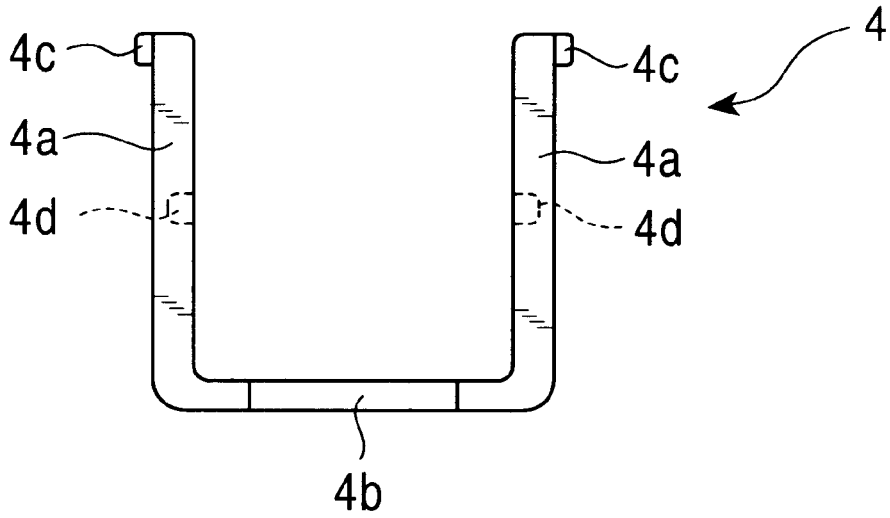
FIG. 11 is a plan view of an outer lever, according to the present invention.
Figure 12:
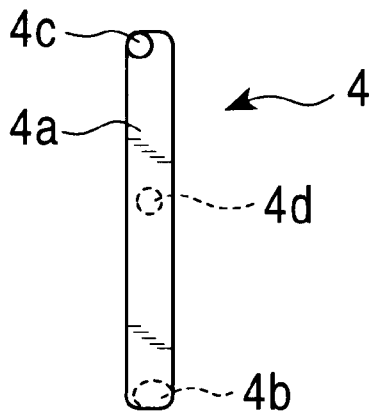
FIG. 12 is a side view of the outer lever shown in FIG. 11.

In FIGS. 11 and 12, the outer lever 4 includes a pair of vertically-extending tilting legs 4*a*. The tilting legs 4*a* are connected to each other via the upper rotational axle 4*b* disposed in a lower part of the outer lever 4 in the drawing, and the outer lever 4 is thereby formed substantially in a U-shape.

The outer lever 4 is provided with lower sliding pins 4*c* each projecting from the outside of the tilting leg 4*a* shown in FIG. 11 at the upper part thereof. The pair of tilting legs 4*a* are individually provided with pin-receiving holes 4*d* each formed by a predetermined depth in the inside of a vertically intermediate part of the tilting leg 4*a*, the pin-receiving holes 4*d* serving to individually receive rotatably the connecting pins 3*d* of the inner lever 3.

In the outer lever 4, which is shown FIG. 1, the upper rotational axle 4*b* which is disposed in an upper part of the outer lever 4 rotatably mates with the rotatable-mating part 2*g* of the actuator 2, and the lower sliding pins 4*c* which are disposed in the lower part of the outer lever 4 slidingly mate with the lever-mounting plate 5.

Figure 14:
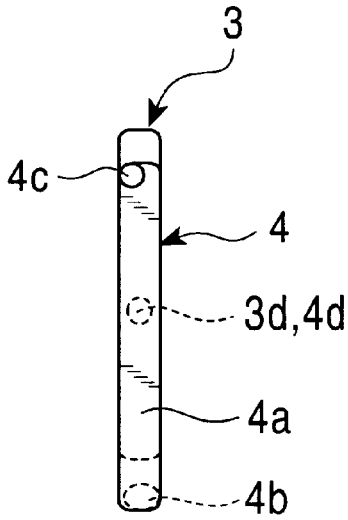
FIG. 14 is a side view of the assembled inner and outer levers shown in FIG. 13.
Figure 15:
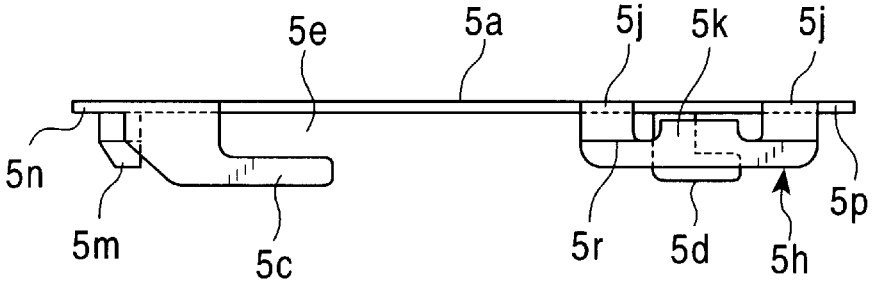
FIG. 15 is a side view of a lever-mounting plate, according to the present invention.
Figure 16:
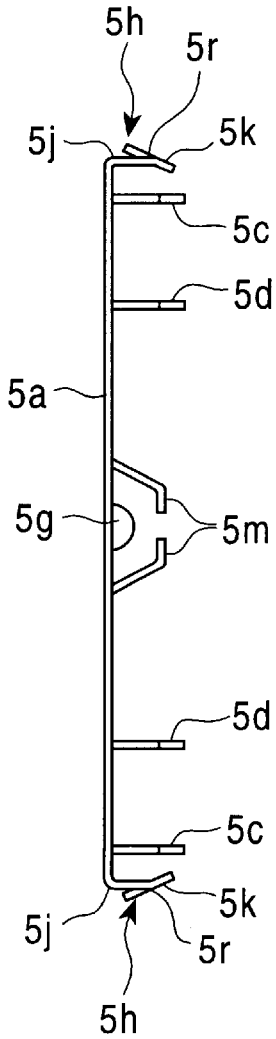
FIG. 16 is a left side view of the lever-mounting part shown in FIG. 15.

The pair of inner and outer levers 3 and 4 are formed, as shown in FIGS. 13 and 14, by two-color-molding or inlay molding in a manner such that the inner and outer levers 3 and 4 are molded in a state in which the connecting pins 3*d* and the pin-receiving holes 4*d* of the inner and outer levers 3 and 4, respectively, are coupled with each other, and the inner and outer levers 3 and 4 are rotatably connected to each other.

The height of the upper sliding axle 3*b* and the upper rotational axle 4*b* varies according to the tilting angle of the tilting legs 3*a* and 4*a*.

The lever-mounting plate 5 is described below with reference to FIGS. 15 to 18. The lever-mounting plate 5 rotatably mates with the lower rotational axle 3*c* at the lower rotational pins 3*e* which are disposed in the lower part of the inner lever 3 and slidingly mates with the lower sliding pins 4*c* which are disposed in the lower part of the outer lever 4.

Figure 17:
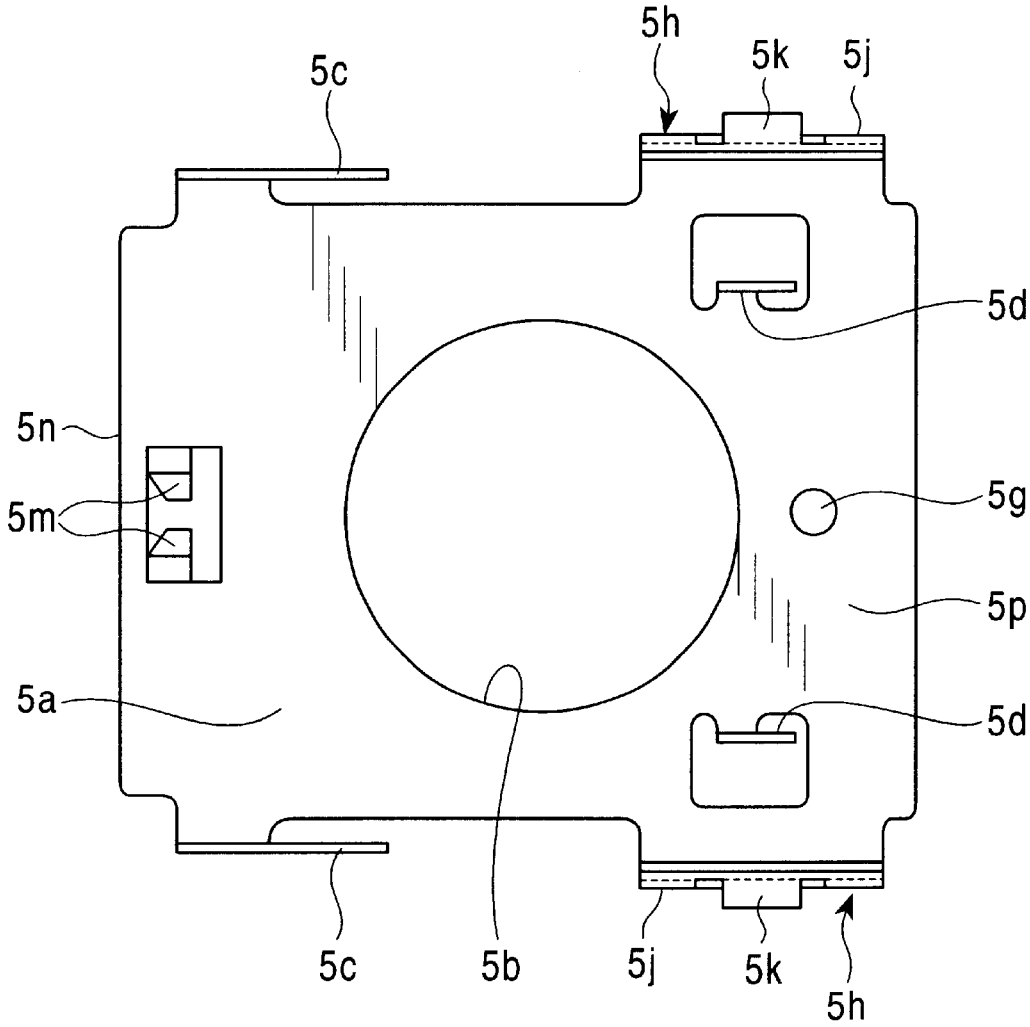
FIG. 17 is a plan view of the lever-mounting part shown in FIG. 15.

The lever-mounting plate 5 is made of a metallic plate such as a stainless plate, and is formed substantially in a rectangle by pressing or the like, as shown in FIG. 17. The lever-mounting plate 5 includes a substantially rectangular base part 5*a* which is provided with a circular through-hole 5*b* for receiving the elastic member 8, which is described below, substantially in a central part of the base part 5*a*.

In FIG. 17, the base part 5*a* is provided with a pair of first cut-and-raised parts 5*c* individually formed toward the left end of the base part 5*a* at the upper and lower sides of the base part 5*a*. The base part 5*a* is also provided with a pair of second cut-and-raised parts 5*d* individually formed toward the right end and toward the upper and lower sides from the through-hole 5*b* of the base part 5*a*.

Figure 18:
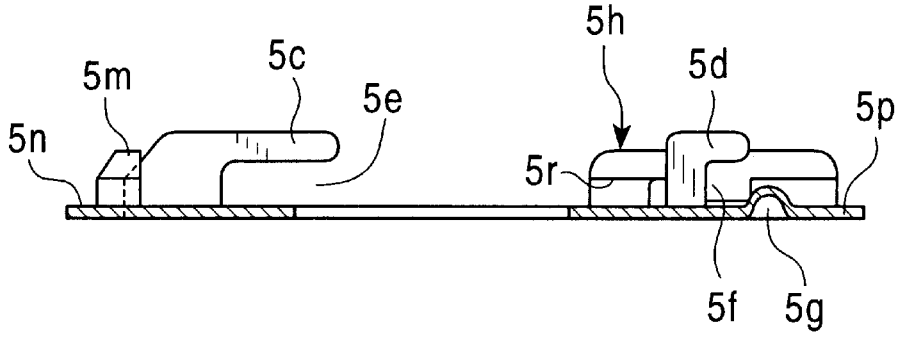
FIG. 18 is a front view of the lever-mounting part shown in FIG. 17.

The first and second cut-and-raised parts 5*c* and 5*d* are individually formed substantially in L-shapes, as shown in FIG. 18. The first cut-and-raised parts 5*c* individually include sliding-mating parts 5*e* formed in a U-shape in side view, and slidingly mate with the lower sliding pins 4*c* of the lower part of the outer lever 4.

The second cut-and-raised parts 5*d* individually include rotatable-mating parts 5*f* formed in a U-shape in side view shallower than those of the sliding-mating parts 5*e*, and mate with the lower rotational pins 3*e* of the lower part of the inner lever 3.

The base part 5*a* is provided with a projection 5*g* projecting upward substantially in an intermediate part between the pair of second cut-and-raised parts 5*d* shown in FIG. 17 and in the vicinity of the rotatable-mating parts 5*f* shown in FIG. 18. The apertures formed by the rotatable-mating parts 5*f* are narrowed in side view by the projection 5*g*.

Therefore, when the lower rotational pins 3*e* of the lower part of the inner lever 3 is pressed into the rotatable-mating parts 5*f*, the projection 5*g* snaps the lower rotational axle 3*c*, whereby the lower rotational pins 3*e* rotatably mate with the rotatable-mating parts 5*f*.

In FIG. 18, the apertures formed by the respective sliding-mating parts 5*e* and the rotatable-mating parts 5*f* open in the same direction to the right as each other.

Therefore, the inner and outer levers 3 and 4 can be mounted to the lever-mounting plate 5 by inserting the lower parts of the respective inner and outer levers 3 and 4 into the rotatable-mating parts 5*f* and the sliding-mating parts 5*e*, respectively, in the same direction, whereby a mounting process can be easily automated.

In FIG. 17, the base part 5*a* of the lever-mounting plate 5 is provided with a mating unit including a pair of mating parts 5*h* formed by cutting and raising edges of the upper and lower sides of the base part 5*a* in the vicinity of the respective second cut-and-raised parts 5*d*. The lever-mounting plate 5 can be temporarily fixed to a holding plate 6, which is described below, at the mating unit including the mating parts 5*h*.

The mating parts 5*h* forming the mating unit are independently formed by cutting and raising the upper and lower edges in FIG. 17, that is, the widthwise ends of the base part 5*a* so as to form sidewalls 5*j*. The sidewalls 5*j*, opposing each other, are formed at the widthwise ends and at the right side of the base part 5*a*.

Figure 26:
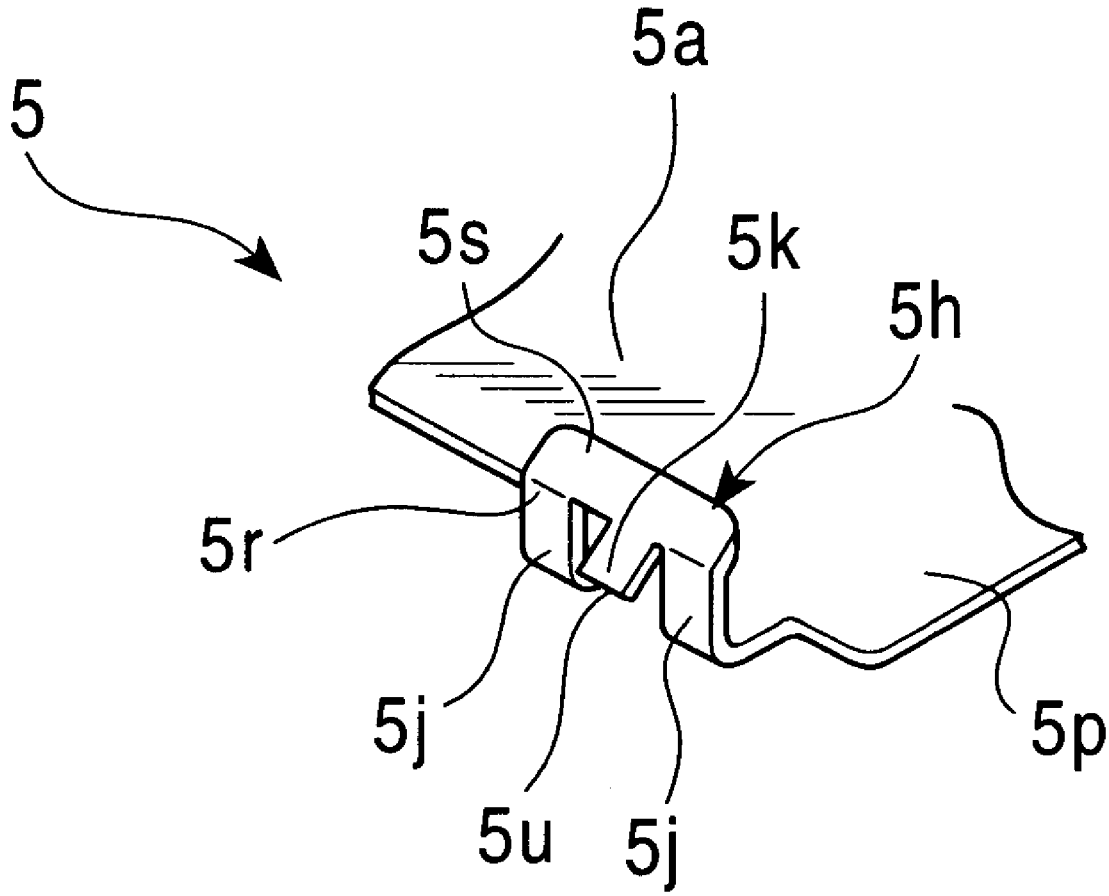
FIG. 26 is a perspective view of a critical portion of the lever-mounting plate, according to the present invention.

Each mating part 5*h* includes a hook 5*k* formed by cutting a part of the sidewall 5*j* which is formed by cutting and raising the base part 5*a* to have substantially right angle with respect to the base part 5*a*, so that the cut part of the sidewall 5*j* is separated from the base part 5*a*, as shown in FIG. 26.

The hook 5*k* includes an end 5*u* which is the cut part of the sidewall 5*j* separated from the base part 5*a*, the end 5*u* obliquely protrudes toward the outside in the widthwise direction of the base part 5*a*. The hook 5*k* is connected to a guide part 5*s* which is an upper part of the sidewall 5*j*.

The guide part 5*s* is inclined toward the inside at a bending line 5*r* by a predetermined angle with respect to the sidewall 5*j*. The hook 5*k* is inclined by the predetermined angle of the guide part 5*s*, and the end 5*u* of the guide part 5*s* protrudes toward the outside from the sidewall 5*j*, as shown in FIG. 26.

In FIG. 17, the base part 5*a* includes a flat first anti-removal part 5*p* which extends toward the outside from a right side edge between the mating parts 5*h* which are opposing each other in the widthwise direction of the base part 5*a*.

The base part 5*a* is provided with a positioning unit including positioning tabs 5*m* formed by cutting and raising a part toward the left side edge of the base part 5*a*. The base part 5*a* includes a flat second anti-removal part 5*n* which extends toward the outside from the positioning tabs 5*m*.

Figure 19:
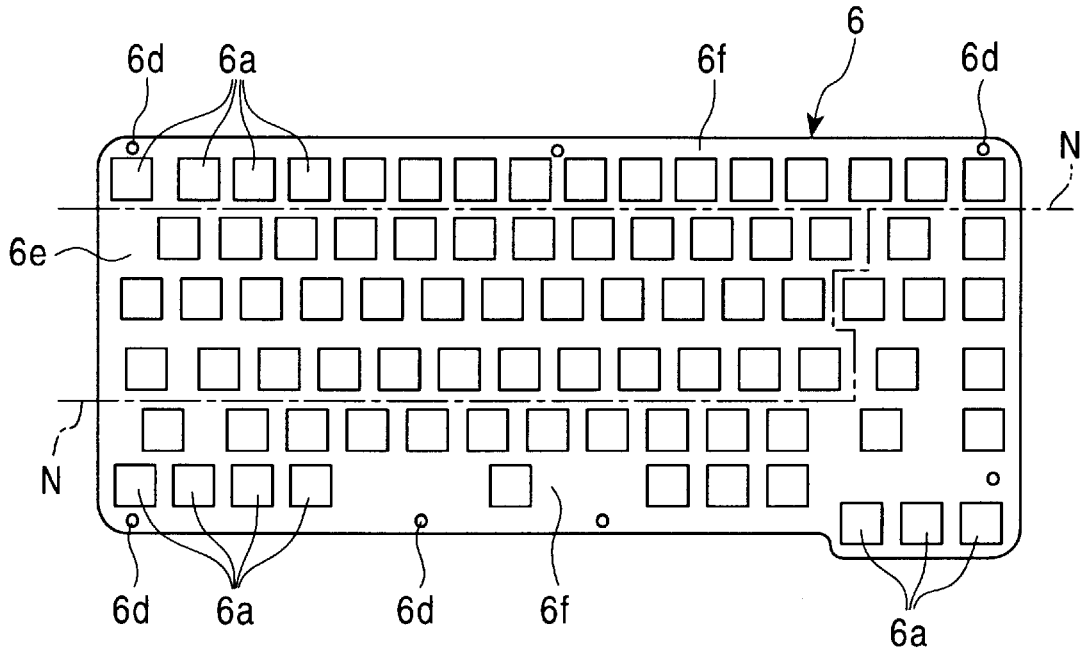
FIG. 19 is a plan view of a holding plate, according to the present invention.

The holding plate 6 shown in FIG. 19 for mounting the lever-mounting plate 5 by snapping at the mating parts 5*h* of the lever-mounting plate 5 is a key-array plate which is made of a metallic plate such as a stainless steel plate. The holding plate 6 is provided with a plurality of mounting holes 6*a* formed by punching by pressing or the like in accordance with the disposition of a plurality of keys of a keyboard.

Figure 20:
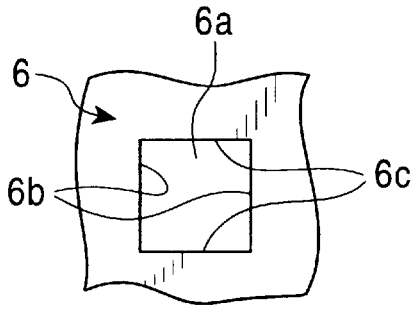
FIG. 20 is an illustration of a critical portion of the holding plate shown in FIG. 19.

In FIG. 20, each mounting hole 6*a* is defined by first edges 6*b* opposing each other and second edges 6*c* opposing each other so as to be formed in a rectangle. The holding plate 6 is provided with a plurality of small circular positioning holes 6*d* formed by punching in the vicinity of the peripheral edges of the holding plate 6.

The holding plate 6 is not necessarily formed with a single key-array plate. It may be formed with a plurality of key-array plates, for example, with a common plate 6*e* and an optional plate 6*f* which are separated from each other at two-dotted-chain lines N, as shown in FIG. 19.

Figure 21:
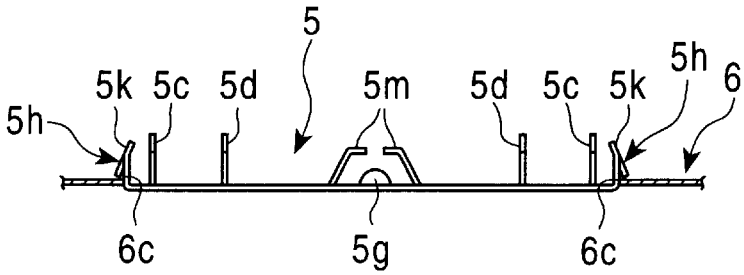
FIG. 21 is an illustration of the holding plate and the lever-mounting plate, according to the present invention, which are assembled with each other.

When the lever-mounting plate 5 is temporarily fixed to the holding plate 6 at each mounting hole 6*a*, the lever-mounting plate 5 is positioned under the holding plate 6, and is lifted, then the hooks 5*k* are inserted while being resiliently deformed along the second edges 6*c* opposing each other of the mounting hole 6*a*, as shown in FIG. 21.

The ends 5*u* of the hooks 5*k* pass through the mounting hole 6*a*, the hooks 5*k* are restored to the original state by their resilient force, the ends 5*u* come into contact with the upper face of the holding plate 6, and the lever-mounting plate 5 is held by the holding plate 6 by snapping so as not to be removed downwardly from the holding plate 6.

When the lever-mounting plate 5 is temporarily fixed to the mounting plate 6, as described above, the lever-mounting plate 5 is prevented from being removed upwardly through the mounting hole 6*a* of the mounting plate 6 with the first and second anti-removal parts 5*p* and 5*n* formed at the right and left sides, respectively, of the base part 5*a* shown in FIG. 17 of the lever-mounting plate 5 coming into contact with the holding plate 6 at the lower face thereof.

The movement of the lever-mounting plate 5 temporarily fixed to the mounting plate 6 at the mounting hole 6*a* is restricted in such a manner that the right edges of the mating parts 5*h* and the left edges of the positioning tabs 5*m* shown in FIG. 17 are respectively brought into contact with the first edges 6*b* of the mounting hole 6*a* opposing each other.

A membrane switch 7 including a plurality of switching elements is provided under the holding plate 6 which temporarily mates with the lever-mounting plate 5, as shown in FIG. 1.

Figure 22:
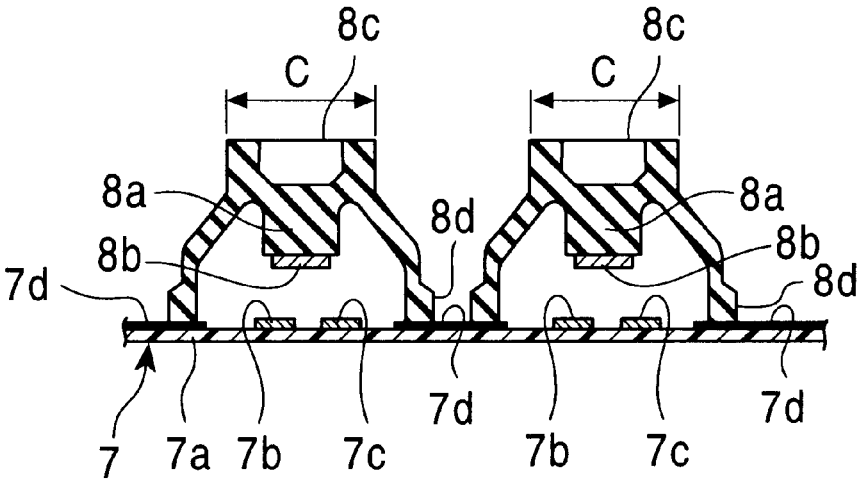
FIG. 22 is a section view of a membrane switch mounted with elastic members, according to the present invention.

In FIG. 22, the membrane switch 7 is provided with first electrodes 7*b* and second electrodes 7*c*, which are switching elements, respectively opposing each other formed by printing or the like on an insulative film 7*a*.

The first electrode 7*b* and the second electrode 7*c* opposing each other are electrically connected to each other, thereby switching on, when a conductive part 8*b* of the elastic member 8, which is described below, comes into contact to the first electrode 7*b* and the second electrode 7*c*.

The insulative film 7*a* of the membrane switch 7 is coated with a resist film 7*d*, having a predetermined thickness, except for the first and second electrodes 7*b* and 7*c*. Wiring patterns (not shown) led from the first and second electrodes 7*b* and 7*c* are insulated by being covered by the resist film 7*d*.

An air vent (not shown) is formed in the insulative film 7*a* in the vicinity of each first or second electrode 7*b* or 7*c*.

In FIG. 22, the elastic member 8 formed in a hollow dome-shape is disposed covering the first electrode 7*b* and the second electrode 7*c*. The elastic member 8 is provided with a depressing projection 8*a* downwardly projecting from the ceiling of the dome-shaped elastic member 8, and the depressing projection 8*a* is provided with the conductive part 8*b* formed of a conductive film by printing or the like on the bottom of the depressing projection 8*a*.

The elastic member 8 is provided with a cylindrical top part 8*c* protruding from the dome-shaped top of the elastic member 8. The outer diameter of the cylindrical top part 8*c* is set to C. The elastic member 8 is provided with a skirt 8*d* in the lower part of the elastic member 8. The elastic member 8 is fixed to the membrane switch 7 via the resist film 7*d* by an adhesive or the like.

A planar metallic plate 9 made of aluminum or the like is disposed under the membrane switch 7 shown in FIG. 1. The metallic plate 9 is provided with air vents formed, associating with the air vents of the membrane switch 7, by punching, the air vents of the metallic plate 9 and the air vents of the membrane switch 7 having the same size as each other. When the elastic member 8 is depressed, the air inside the elastic member 8 is discharged through the air vents, whereby the elastic member 8 can be easily deformed.

The membrane switch 7 is mounted on the metallic plate 9, and the holding plate 6 temporarily mounted with the lever-mounting plate 5 is mounted on the membrane switch 7.

A method for manufacturing the keyboard device having the above-described configuration, according to the present invention, is described below with reference to FIGS. 23 to 25. In FIG. 25, the inner and outer levers 3 and 4 formed and assembled by inlay molding are mounted to the lever-mounting plate 5 at the lower ends of the inner and outer levers 3 and 4 in such a manner that the lower rotational pins 3*e* disposed at the lower end of the inner lever 3 are positioned in the vicinity of the aperture of the rotatable-mating parts 5*f* of the second cut-and-raised parts 5*d*, and the lower sliding pins 4*c* disposed at the lower end of the outer lever 4 are positioned in the vicinity of the aperture of the sliding-mating parts 5*e* of the first cut-and-raised parts 5*c*.

In FIG. 25, when the pair of inner and outer levers 3 and 4 move from one position to another position, that is, from the right to the left in the drawing, the lower sliding pins 4*c* disposed at the lower end of the outer lever 4 move in a direction D, and mate with the sliding-mating parts 5*e* of the first cut-and-raised parts 5*c*.

When the lower rotational pins 3*e* of the inner lever 3 is inserted into the rotationally-mating parts 5*f* by moving in a direction E, which is the same direction as the direction D, the lower rotational axle 3*c* moves to the left in the drawing while being bent by the projection 5*g*, and the lower rotational pins 3*e* mate with the rotatable-mating parts 5*f* by snapping, whereby the lower rotational pins 3*e* are prevented from removal.

The lower rotational pins 3*e* rotatably mate with the rotatable-mating parts 5*f*, respectively, and the lower sliding pins 4*c* slidingly mate with the sliding-mating parts 5*e*, respectively.

The pair of inner and outer levers 3 and 4 can be mounted to the lever-mounting plate 5 at the lower ends of the inner and outer levers 3 and 4 only by moving the pair of inner and outer levers 3 and 4, which are connected to each other at an intersection thereof, from one position to another position, because the sliding-mating parts 5*e* and the rotatably-mounting parts 5*f* of the lever-mounting plate 5 are open in the same direction as each other. Therefore, manufacturing processes can be easily automated.

Figure 24:
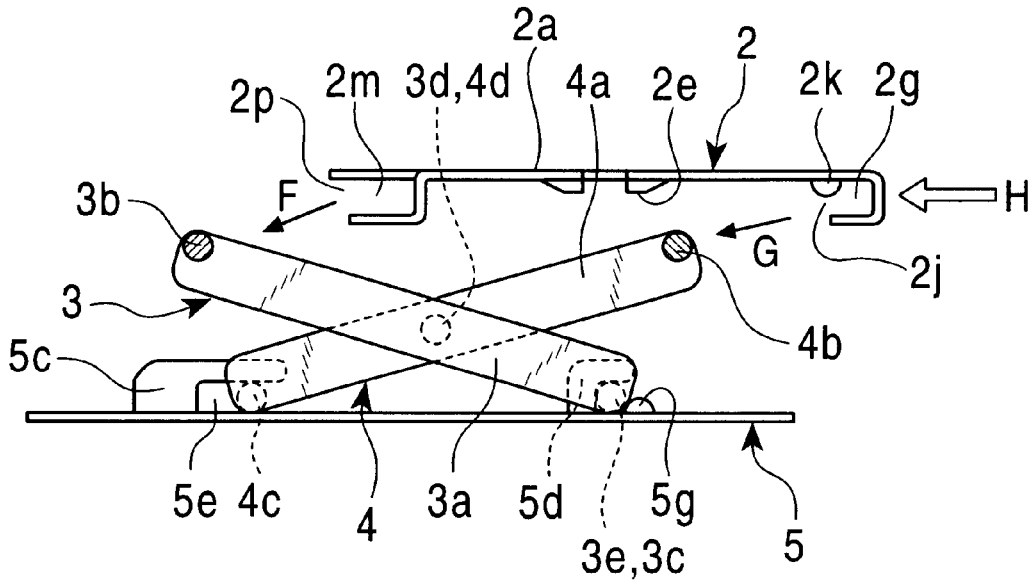
FIG. 24 is an illustration showing the manufacturing method of the keyboard according to the present invention.
Figure 25:
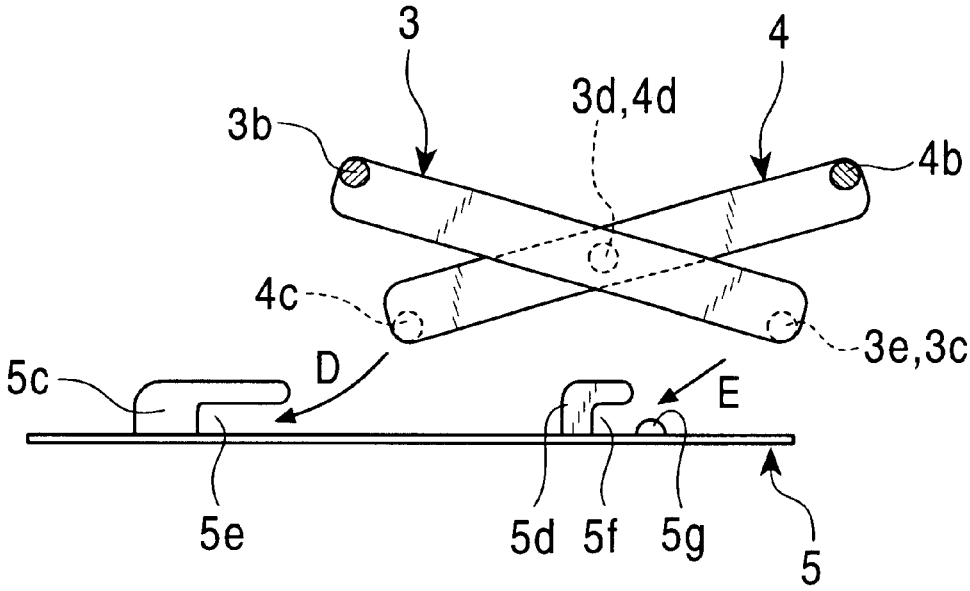
FIG. 25 is an illustration showing the manufacturing method of the keyboard according to the present invention.

Next, the lever-mounting plate 5, which has been mounted with the pair of inner and outer levers 3 and 4 at the lower ends thereof, is mounted to the actuator 2 at the upper ends of the inner and outer levers 3 and 4 while the pair of inner and outer levers 3 and 4 mounted on the lever-mounting plate 5 are in an X-shape, as shown in FIG. 24.

The actuator 2 is positioned with respect to the pair of inner and outer levers 3 and 4 mounted on the lever-mounting plate 5 and formed in an X-shape, such that the aperture 2*j* of the rotatable-mating parts 2*g* of the actuator 2 associates with the upper rotational axle 4*b* of the outer lever 4 and the aperture 2*p* of the sliding-mating parts 2*m* of the actuator 2 associates with the upper sliding axle 3*b* of the inner lever 3.

When a load is applied to the actuator 2 from the rotatable-mating part 2*g* side in a direction H parallel to the mounting face 2*a*, the actuator 2 moves from one position to another position, that is, from the right to the left in the drawing, the sliding-mating parts 2*m* move in a direction F, and the upper sliding axle 3*b* of the inner lever 3 is inserted to and is slidingly received by the slidingly-mounting parts 2*m*.

The rotatable-mating parts 2*g* move in a direction G, and the upper rotational axle 4*b* of the outer lever 4 is inserted to by snapping and is rotatably received by the rotatable-mating parts 2*g*.

The actuator 2 can be mounted to the pair of inner and outer levers 3 and 4 only by moving the actuator 2 from one position to another position because the apertures of the rotatable-mating parts 2*g* and the sliding-mating parts 2*m* are open in the same direction as each other. Therefore, manufacturing processes can be easily automated.

Figure 23:
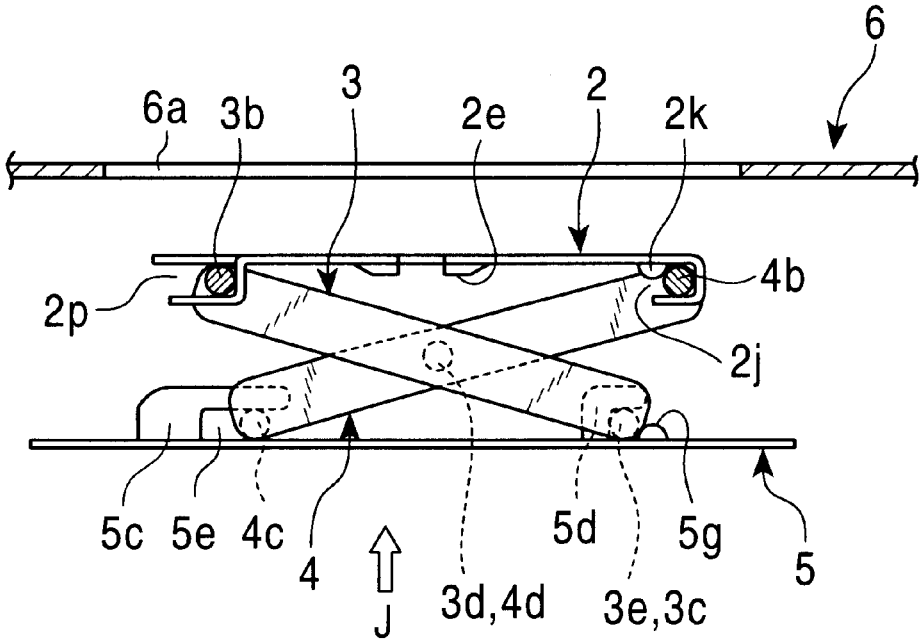
FIG. 23 is an illustration showing a manufacturing method of the keyboard according to the present invention.

Then, the lever-mounting plate 5, which is mounted with the actuator 2 with the pair of inner and outer levers 3 and 4 therebetween, is temporarily mated with each mounting hole 6*a* of the holding plate 6 by snapping such that the lever-mounting plate 5 mounted with the actuator 2 and the pair of inner and outer levers 3 and 4 is positioned under the mounting hole 6*a*, as shown in FIG. 23.

When the lever-mounting plate 5 is lifted in a direction J, the mating unit including the mating parts 5*h* of the lever-mounting plate 5 is pressed into and is fit by snapping to the mounting hole 6*a*, the first and second anti-removal parts 5*p* and 5*n* are brought into contact with the bottom surface of the holding plate 6 so as not to be removed upward, and the lever-mounting plate 5 mounted with the actuator 2 and the inner and outer levers 3 and 4 is mounted to the holding plate 6 at each mounting hole 6*a* thereof.

The lever-mounting plate 5, which is mounted with the actuator 2 and the pair of inner and outer levers 3 and 4, is mounted to the holding plate 6 in such a manner that a plurality of the lever-mounting plates 5 each mounted with the actuator 2 and the pair of inner and outer levers 3 and 4 are placed under the holding plate 6 so that the lever-mounting plates 5 associate with the mounting holes 6*a* formed in the holding plate 6, and the plurality of lever-mounting plates 5 are simultaneously lifted so as to mate with the associating mounting holes 6*a* by snapping through one-touch operation. Therefore, the manufacturing processes can be easily automated.

Figure 2:
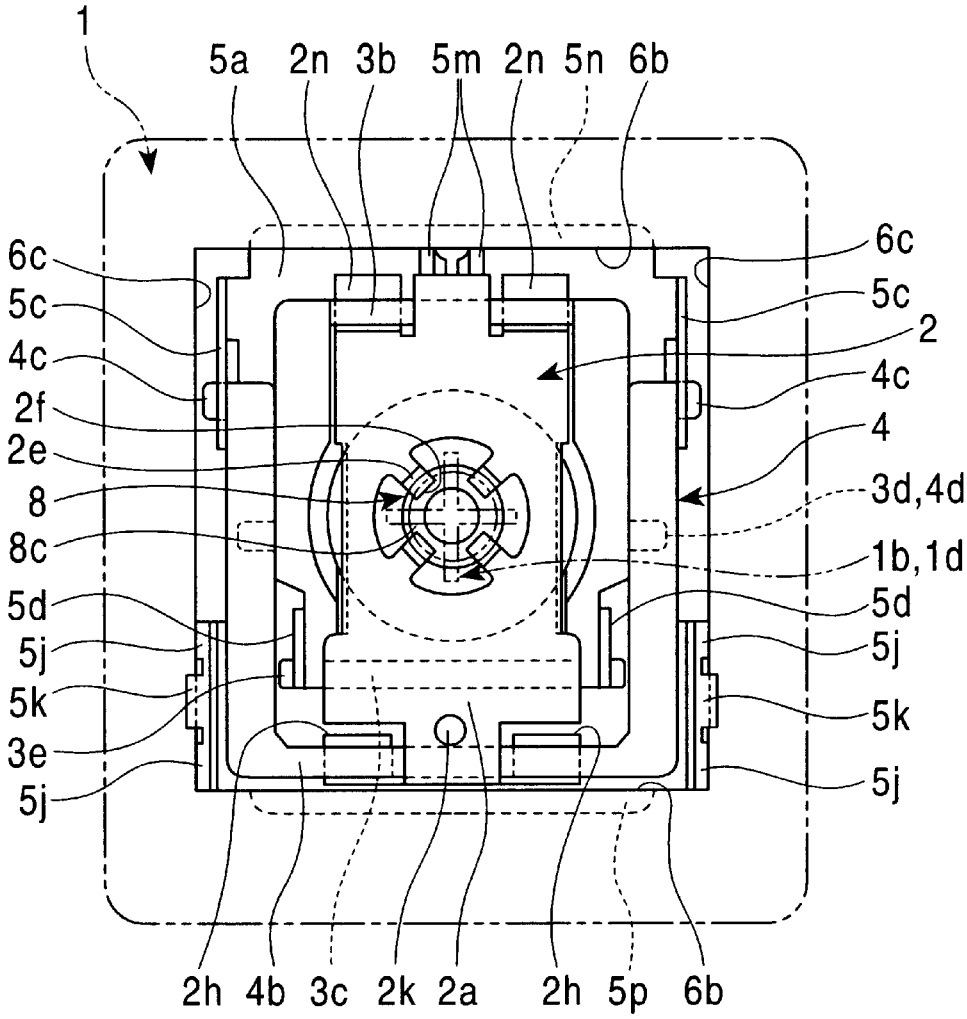
FIG. 2 is a plan view of the critical portion of the keyboard device shown in FIG. 1.

Even when a twisting force is applied to the lever-mounting plate 5, the twist thus produced can be restricted by respective lower edges, as shown in the drawing, of the sidewalls 5*j* of the mating parts 5*h* included in the mating unit of the lever-mounting plate 5, which are in contact with one of the first edges 6*b* of each mating-hole 6*a*, and the positioning parts 5*m* included in the positioning unit of the lever-mounting plate 5, which are in contact with the other one of the first edges 6*b* of the mating-hole 6*a*, as shown in FIG. 2.

The twist of the lever-mounting plate 5 can be more reliably restricted by providing a plurality of the positioning units, each including the positioning parts 5*m*, disposed along the first edges 6*b* of the mounting hole 6*a* of the holding plate 6.

Next, the key tops 1 are mounted to the actuators 2, which are each mounted with the lever-mounting plate 5 including the pair of inner and outer levers 3 and 4 and are each mounted to the mounting hole 6*a* of the holding plate 6. The protrusion 1*b* of each key top 1 is positioned to be associated with the anti-removal part 2*b* of the actuator 2, and the pressing part 1*d* in a cross-shape of each key top 1 is positioned between each pressure-contact tab 2*e*.

The actuator 2 is placed on a jig (not shown) at a bottom face opposite to the mounting face 2*a* of the actuator 2, and the key top 1 is depressed by another jig or the like, whereby the protrusion 1*b* is pressure-fit to the anti-removal part 2*b* of the actuator 2.

In this case, the respective ends 2*f* of the four pressure-contact tabs 2*e* are brought into pressure-contact with the four side faces 1*c* of the protrusion 1*b*, thereby mounting the key top 1 to the actuator 2 so as not to be removed.

A plurality of the key tops 1 are positioned on a plurality of the actuators 2, respectively, and the plurality of key tops 1 can be simultaneously pressure-fit to the plurality of actuators 2, respectively, in one pressure-fitting process. Therefore, the manufacturing processes can be automated.

Then, the membrane switch 7 provided with a plurality of the elastic members 8 is mounted on the metallic plate 9 shown in FIG. 1, and the holding plate 6 mounted with the lever-mounting plates 5 and the actuators 2 with the inner and outer levers 3 and 4 therebetween is mounted on the membrane switch 7.

The tops 8*c* of the plurality of elastic members 8 pass through the respective through-holes 5*b* provided in each lever-mounting plate 5, and come into contact with the cross-shaped pressing parts 1*d*, respectively, of the key tops 1, whereby each key top 1 is urged upward and a pair of the inner and outer levers 3 and 4 thereby extend to move in an X-shape, as shown in FIG. 1.

In the thus formed keyboard device according to the present invention, when the key top 1 shown in FIG. 1 is depressed, the tilting legs 3*a* and 4*a* of the inner and outer levers 3 and 4, respectively, which are crossing each other, are tilted, and the tilting legs 3*a* and 4*a* are thereby each positioned substantially horizontal.

In this state, the dome-shaped elastic member 8 is pressed by the pressing part 1*d* and is deformed and buckled. The buckling of the elastic member 8 produces a clicking sensation. The conductive part 8*b* of the elastic member 8 comes into contact with the corresponding first and second electrodes 7*b* and 7*c* disposed on the membrane switch 7, whereby the first and second electrodes 7*b* and 7*c* are electrically connected.

Thus, a switching element formed with the first and second electrodes 7*b* and 7*c* is put on.

The clicking sensation produced in the elastic member 8 is transferred to the key top 1 because the elastic member 8 is in contact with and thereby urges the key top 1; therefore superior feeling in manipulation of the key tops 1 can be obtained.

When the pressing force applied to the key top 1 is released in a switch-on state of the switching element, the deformed elastic member 8 is restored by its elastic force to the original dome-shape. Then, the key top 1 is pressed upward by the elastic member 8 at the pressing part 1*b* of the key top 1.

The tilting legs 3*a* and 4*a* of the inner and outer levers 3 and 4, respectively, are restored to the original form in an X-shape shown in FIG. 1. When the elastic member 8 is restored to the original dome-shape, the conductive part 8*b* in contact with and electrically connecting the first and second electrodes 7*b* and 7*c* with each other ascends so as to put the switching element off.

Figure 27A:
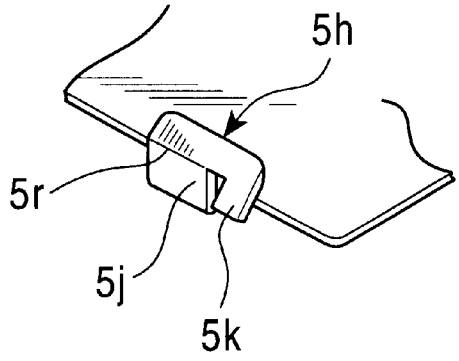
FIGS. 27A, 27B, 27C, and 27D are illustrations of modified examples of the critical portion of the lever-mounting plate, according to the present invention.

Although according to the embodiment of the present invention, each mating part 5*h* of the lever-mounting plate 5 is formed, as shown in FIG. 26, the mating part 5*h* may be formed including the hook 5*k* disposed at a lateral side of the sidewall 5*j*, as shown in FIG. 27A.

The hook 5*k* may be formed by cutting and separating a part of the sidewall 5*j* of the mating part 5*h* from the base part 5*a*, and an end of the hook 5*k* formed so as to be inclined, at which the hook 5*k* is cut from the base part 5*a*, may protrude toward the outside in a widthwise direction. The mating part 5*h* including the hooks 5*k* of the sidewalls 5*j* mates with the mounting hole 6*a* by snapping to the hooks 5*k*.

Figure 27B:
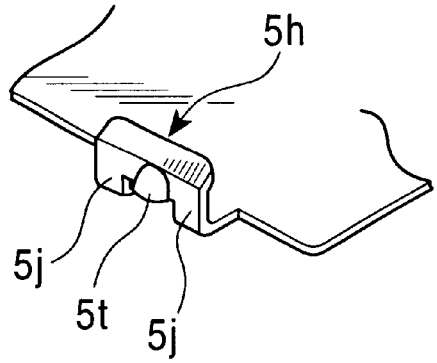

The mating part 5*h*, which includes the sidewalls 5*j* cut and raised at a right angle with respect to the base part 5*a*, may be provided with hemispherical projections 5*t* projecting toward the outside in the widthwise direction, each projection 5*t* formed on the sidewall 5*j*, as shown in FIG. 27B, instead of the hook 5*k*.

Figure 27C:
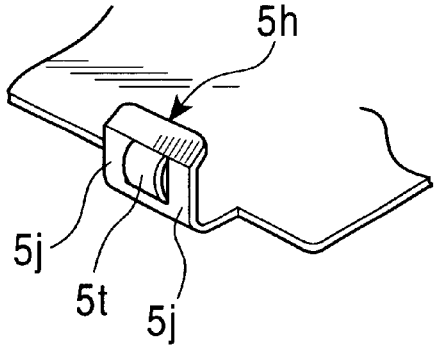

The projection 5*t* formed on the sidewall 5*j* may be formed in an arc by cutting a part of the sidewall 5*j*, as shown in FIG. 27C.

Figure 27D:
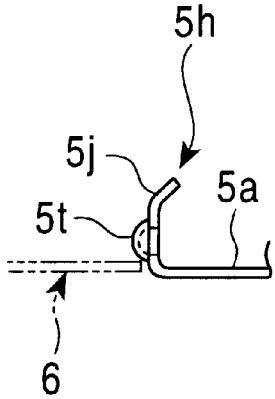

The projection 5*t* may be projected from the sidewall 5*j* in a spherical shape, as shown in FIG. 27D.

As described above, each of the mating parts 5*h* which form a mating unit of the lever-mounting plate 5 may include the sidewall 5*j* provided with the projection 5*t* which projects to the outside in the widthwise direction of the base part 5*a*, and the mating parts 5*h* forming the mating unit may mate with each mounting hole 6*a* by snapping to the mating parts 5*h*.

What is claimed is:

1. A keyboard device comprising:

a pair of levers rotatably connected to each other at an intersection therebetween;

a key top which is vertically movable and is supported by the pair of levers;

an elastic member for elastically urging the key top upward;

a switching element for performing switching in accordance with vertical movement of the key top;

a lever-mounting plate for mating with the pair of levers at lower ends of the levers, the lever-mounting plate being provided with a mating unit;

a holding plate for holding the lever-mounting plate by snapping at the mating unit of the lever-mounting plate; and a membrane switch formed on a film sheet and including the switching element, the membrane switch positioned below the lever-mounting plate and the holding plate.

2. A keyboard device according to claim 1, wherein the lever-mounting plate is made of a metallic plate which has a planar base part, the mating unit includes sidewalls opposing each other formed by cutting and raising widthwise ends of the base part, and the holding plate is provided with a plurality of mounting holes, the mating unit mating with one of the mounting holes by snapping.

3. A keyboard device according to claim 2, wherein the mating unit is provided with protrusions each protruding toward an outside in the widthwise direction from a part of each sidewall, and the mating unit mates with said one of the mounting holes by snapping at the protrusions.

4. A keyboard device according to claim 2, wherein the sidewalls of the mating unit continuing from the base part are each provided with a hook formed by separating a part of the sidewall from the base part, the hook is formed with an end of the part of the sidewall, the hook being inclined and protruding toward an outside in the widthwise direction, and the hooks mate with said one of the mounting holes by snapping.

5. A keyboard device according to claim 2, wherein the mounting holes are rectangular and each mounting hole is defined by first edges opposing each other and second edges opposing each other, the mating unit is formed at the widthwise ends toward one side of the base part, a positioning unit is formed by cutting and raising a portion of the base part toward the other side of the base part, and the mating unit mates with said one of the mounting holes by snapping at the second edges opposing each other of said one of the mounting holes such that one end face of the mating unit comes into contact with one of the first edges and the positioning unit comes into contact with the other one of the first edges.

6. A keyboard device according to claim 5, wherein the base part includes a first anti-removal part which extends toward the outside from a portion of the base part toward said one side of the base part between the widthwise ends at which the mating unit is disposed and a second anti-removal part which extends toward the outside from the positioning unit which is disposed toward the other side of the base part, the first and second anti-removal parts coming into contact with a bottom surface of the holding plate when the mating unit mates with said one of the mounting holes by snapping.

7. A keyboard device comprising:

a pair of levers rotatably connected to each other at an intersection therebetween;

a key top which is vertically movable and is supported by the pair of levers;

an elastic member which urges the key top upward;

a switching element for performing switching in accordance with vertical movement of the key top;

a lever-mounting plate for mating with a lower end of one of the pair of levers; and an actuator coupled with the key top, for mating with the pair of levers at upper ends thereof, the actuator being provided with a first rotatable-mating unit including an aperture at which one of the upper ends of the pair of levers rotatably mates with the first rotatable-mating unit and a first sliding-mating unit including an aperture at which the other one of the upper ends of the pair of levers is slidingly mated with the first sliding-mating unit, the apertures of the respective first rotatable-mating unit and the first sliding-mating unit being open in the same direction as each other, the lever-mounting plate having a second rotatable-mating unit for rotatably mating with the lower end of the one of the pair of levers and a second sliding-mating unit for slidably mating with a lower end of the other of the pair of levers, the apertures of the respective second rotatable-mating unit and the second sliding-mating unit being open in the same direction as each other, and the apertures of the respective first rotatable-mating unit and first sliding-mating unit being open in an opposing direction as the apertures of the respective second rotatable-mating unit and second sliding-mating unit.

8. A keyboard device according to claim 7, wherein the first rotatable-mating unit is formed in a U-shape and is disposed at an end of the actuator, and is provided with a projection formed in the vicinity of the aperture on at least one of two side members opposing each other which form the U-shaped rotatable-mating unit, the projection serving to narrow the aperture.

9. A keyboard device according to claim 7, wherein the first sliding-mating unit is formed in a U-shape and is disposed at an end of the actuator, and two side members are formed opposing each other and parallel to each other, the two side members forming the U-shaped sliding-mating unit.

10. A keyboard device according to claim 9, wherein the actuator is made of a metallic plate and is provided with the first sliding-mating unit formed by cutting and bending said end of the actuator and the first rotatable-mating unit formed by cutting and bending the other end of the actuator.

11. A method for manufacturing a keyboard device, comprising:

rotatably connecting a pair of levers to each other at an intersection therebetween;

mating the pair of levers with an actuator so that upper ends of the pair of levers vertically move in accordance with vertical movement of a key top;

mating, by snapping, a lever-mounting plate with one of a plurality of mounting holes formed in a holding plate in an upward direction, the lever-mounting plate being mated with the pair of levers at lower ends thereof, whereby the lever-mounting plate is mounted to the holding plate; and assembling the lever-mounting plate prior to positioning a membrane switch below the lever-mounting plate and the holding plate.

12. A method for manufacturing a keyboard device, according to claim 11, further comprising forming a mating unit on the lever-mounting plate, and mating the mating unit with said one of the mounting holes by snapping by lifting the lever-mounting plate disposed under the holding plate.

13. A method for manufacturing a keyboard device, comprising:

rotatably connecting a pair of levers to each other at an intersection therebetween;

mating an actuator with a key top, mating the actuator with the pair of levers at upper ends thereof, such that the pair of levers vertically move via the actuator in accordance with vertical movement of the key top which is elastically urged by an elastic member;

mating the actuator with the pair of levers such that the actuator is positioned on the pair of levers at the upper ends thereof and is moved from one position to another position, whereby the actuator mates with the pair of levers at the upper ends thereof;

limiting lateral movement of the upper ends of the pair of levers by rotatably mating the upper end of one of the pair of levers in an aperture of a first rotatable-mating unit in which the aperture of the first rotatable-mating unit is open in a first direction and slidingly mating the upper end of the other of the pair of levers in an aperture of a first sliding-mating unit in which the aperture of the first sliding-mating unit is open in the first direction; and mating lower ends of the pair of levers at a lever-mounting plate and limiting lateral movement of the lower ends of the pair of levers by rotatably mating the lower end of one of the pair of levers in an aperture of a second rotatable-mating unit in which the aperture of the second rotatable-mating unit is open in a second direction and slidingly mating the lower end of the other of the pair of levers in an aperture of a second sliding-mating unit in which the aperture of the second sliding-mating unit is open in the second direction.

14. A method for manufacturing a keyboard device, according to claim 13, wherein by moving from said one position to said other position, the actuator mates, by snapping, the first rotatable-mating unit provided at one end of the actuator with the pair of levers at one of the upper ends thereof and slidingly mates the first sliding-mating unit provided at the other end of the actuator with the pair of levers at the other one of the upper ends thereof.

* * * * *